US005890588A

United States Patent [19]

Leonard et al.

[11] Patent Number: 5,890,588

[45] Date of Patent: Apr. 6, 1999

[54] BRUSH CONTAINER WITH LOCKING DEVICE

[75] Inventors: Stephen B. Leonard, Franksville, Wis.; Gary F. Prokop; William A. Lee, both of Wheaton, Ill.

[73] Assignee: S. C. Johnson & Son, Inc.

[21] Appl. No.: 933,728

[22] Filed: Sep. 23, 1997

[51] Int. Cl.[6] ..... A45D 44/18

[52] U.S. Cl. ..... 206/15.3; 206/1.5; 206/209

[58] Field of Search ..... 206/361, 15.2, 206/15.3, 580, 1.5, 209, 209.1, 362.2, 362.3; 248/222.12, 222.11, 222.13

[56] References Cited

U.S. PATENT DOCUMENTS

| | | | |
|---|---|---|---|
| 2,844,275 | 7/1958 | Keller . | |
| 3,642,166 | 2/1972 | Starr . | |
| 4,095,718 | 6/1978 | Kong . | |
| 4,676,370 | 6/1987 | Rudick | 206/1.5 |
| 4,997,629 | 3/1991 | Marchand et al. | 422/300 |
| 5,040,691 | 8/1991 | Hayes et al. . | |
| 5,092,480 | 3/1992 | Pradel . | |

OTHER PUBLICATIONS

A Nov. 22, 1996 Prodimex ad entitled "Toilet Brush Holder".

*Primary Examiner*—Paul T. Sewell
*Assistant Examiner*—Nhan T. Lam

[57] ABSTRACT

Disclosed herein is a combined toilet bowl cleaning brush and storage container system. The brush is provided with a disk shaped wall which rests on an internal sealing ledge of the container. A entry deterent latching system is provided above the disk shaped wall to hold the wall in place and seal the container. A plurality of steps are required to unlatch the brush prior to use.

15 Claims, 5 Drawing Sheets

BRUSH CONTAINER WITH LOCKING DEVICE

TECHNICAL FIELD

This invention relates to toilet bowl cleaning brushes and containers for storing them. More particularly, it relates to scalable and securable containers for storing such brushes.

BACKGROUND ART

Toilet bowls can become stained due to chemicals present in a water supply or due to residual waste. To remove stains many toilet bowl cleaning products contain surfactants applied with a brush. During cleaning, a brush often becomes soiled and contaminated with germs. Even after rinsing, there can still be residual waste on the brush (or at least the perception that such waste has not been fully rinsed off). In any event the brush will be damp.

As such, toilet bowl brushes are often stored in a container between uses. In addition, some containers are provided with a liquid disinfectant formulated to sanitize a brush between uses. Such brushes and their containers are preferably stored on the floor near a toilet.

However, disinfectants may contain ingredients which are harmful if ingested. Very young children may not be able to recognize that a toilet brush and its container contain harmful products. Thus, in households with young children such containers are usually stored in locked cabinets or closets (rather than the preferred site, next to a toilet).

While various entry deterent devices have been developed (e.g. in the pharmaceutical container field), applying these concepts to toilet brush container systems can lead to unnecessarily complex designs, an insufficient seal and thus spillage or odors, and/or an ineffective locking device. Alternately, this might require a user to touch the top of the container in order to unlock or lock the container. This may be objectionable in this application as brush drippage might have contaminated the top portion of a container during insertion or extraction.

It can therefore be seen that a need exists for an improved entry deterrent device for a toilet bowl brush/container system.

BRIEF SUMMARY OF THE INVENTION

In one aspect the invention provides a combined brush and storage container system. The system includes a container having an upper edge, an internal storage cavity extending downward from the edge to define a peripheral cavity sidewall and a ledge formed on the sidewall. A radially resilient collar is disposed over the ledge and has first and second ends and a latch extending radially inward.

A key (preferably a ring-like skirt) is mounted on the upper edge over the collar for maintaining the collar within the cavity. A brush having an upper handle, a radially extending support below the upper handle, and a lower brush portion below the support is provided. When the brush portion is inserted in the container the support is supported over (preferably on) the ledge.

Relative movement of the first and second collar ends from a first position to a second position can drive the latch radially outward from a position blocking removal of the brush. Return of the ends to the first position from the second position can cause the latch to move radially inward into a locking position. The collar and cavity are preferably cylindrical.

In one aspect the collar includes oppositely facing inner and outer surfaces and the latch extends radially inward from the inner surface. In this aspect, the key is mounted for rotational movement around the edge and includes a lower portion extending downward into the cavity between the collar and the sidewall, the lower portion having an internal surface. The collar external surface and lower portion internal surface each are a limiting surface. A first of the limiting surfaces forms a foot extension extending radially toward the other. There is also a recess in the other.

In this aspect, when the key is in a first placement the foot is misaligned with the recess and contacts the first limiting surface (limiting the first and second ends to the first position). When the key is rotated from the first to a second placement, the foot is aligned with the recess and the first and second ends of the collar can be moved relative to each other. The collar external surface can be a first of the limiters circumferentially adjacent the latch. Also, preferably, the collar external surface is the first limiting surface and the key internal surface is the second limiting surface.

In another aspect, there are two latches extending inward from opposite sides of the collar, two recesses formed on opposite sides of the collar and two feet extending from opposite sides of the lower portion. In yet another aspect the first and second ends are essentially 90 circumferential degrees from the two latches.

In another embodiment, an alignment post extends axially downwardly from the collar opposite the first and second ends and the ledge forms an aperture for receiving the post.

The container has an opening in the sidewall adjacent the first and second ends, the collar including first and second tabs which are part of the first and second ends, respectively. The first and second tabs extend radially outward through the opening to provide a pinch operated locking system. In this regard, the first and second ends overlap such that when the first end is pinched toward the second end it expands the collar, thus freeing the brush.

In one other aspect, the key and the container include first and second exterior markings, respectively, the markings being aligned when the latch does not inhibit the removal of the brush.

The brush support is preferably a wall and disinfectant fluid is preferably placed in the container cavity.

The invention also includes a method of storing such a brush. One positions the brush in the above described container.

It will be appreciated from the discussion below that the present invention provides an assembly for storing a toilet bowl cleaning brush where the bristles/pad of the brush are immersible in a disinfectant between use. A user can pick up the assembly by the brush handle and transport the entire assembly to another place.

In addition, a dependable sealing/locking device is provided which requires several affirmative steps to unlock the container, thereby making it difficult for a young child to access the disinfectant therein. Moreover, a brush locked with the inventive system can be unlocked without touching the top of the container.

A primary object of the invention is to provide a system of the above kind which requires a number of affirmative actions to open, thus rendering the opening process relatively difficult for a young child (yet simple for most adults).

Another object of the invention is to provide a storage container for a cleaning brush in which the container is designed to store both the brush and a disinfectant with reduced risk of spillage.

Another object of the invention is to provide a system of the above kind which inhibits odors from escaping the container.

Another object of the invention is to provide a system of the above kind which is comprised of few parts, which is inexpensive to produce, and which is easy for a consumer to use.

Still other objects and advantages of the present invention (e.g. methods for using these systems) will become apparent from examination of the specification and claims which follow.

MODES FOR CARRYING OUT INVENTION

Figure 1:
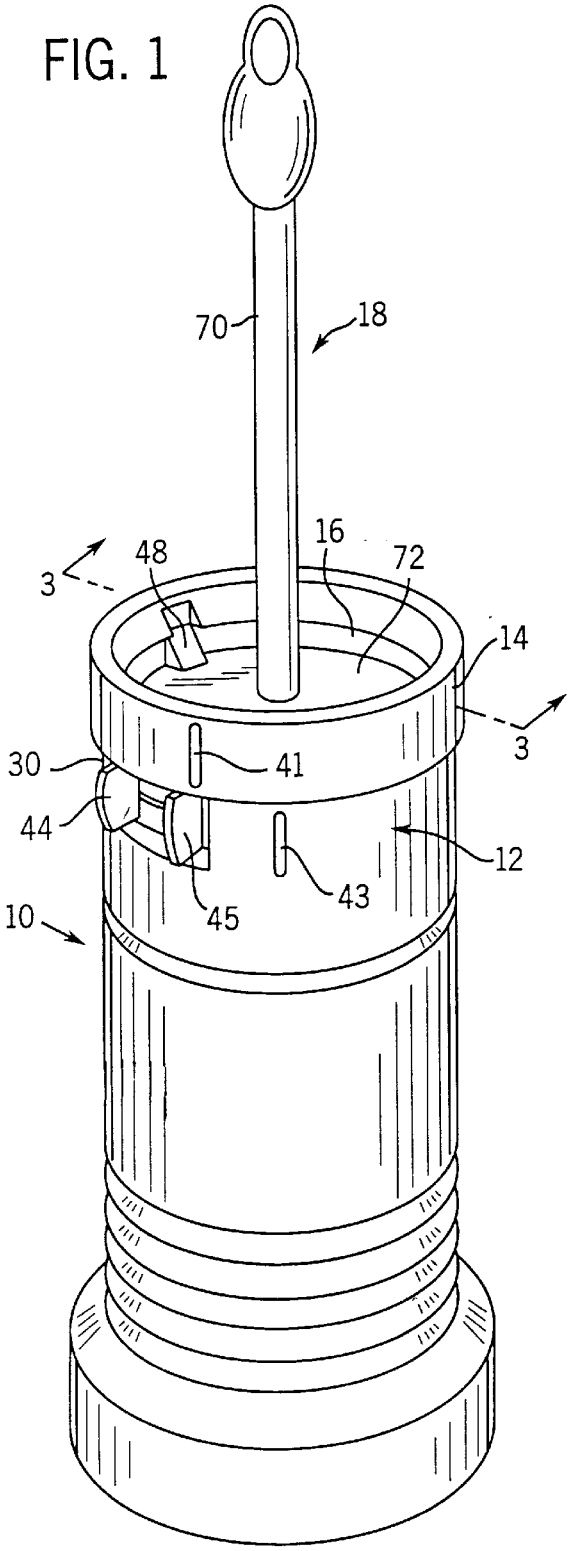
FIG. 1 is perspective view of an embodiment of the inventive system.
Figure 2:
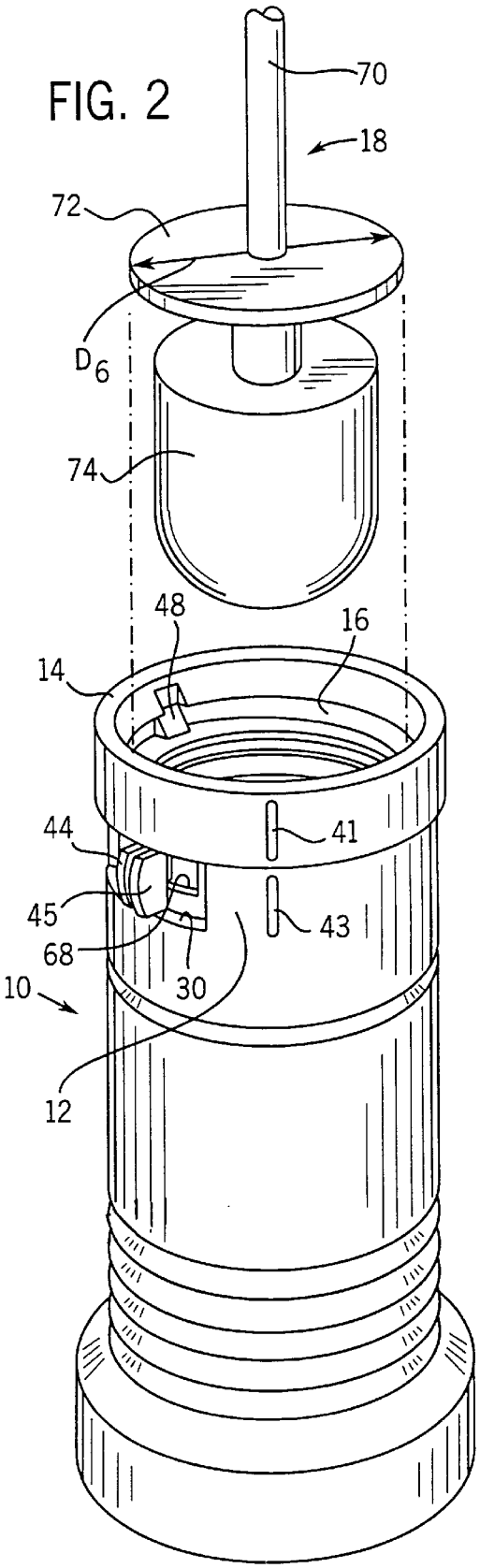
FIG. 2 is an exploded perspective view of the system of FIG. 1.
Figure 3:
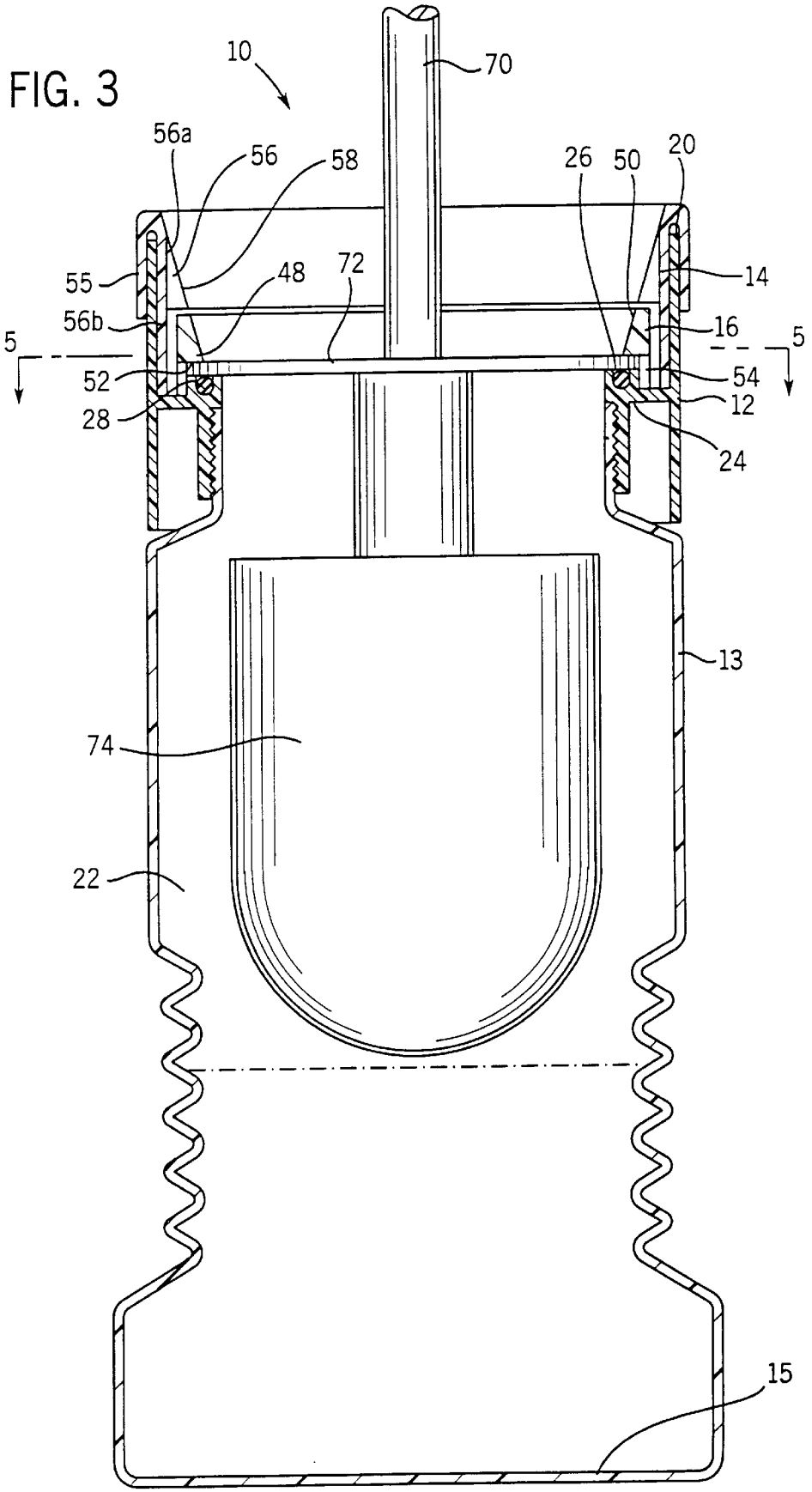
FIG. 3 is a cross-sectional view taken along line 3—3 in FIG. 1.
Figure 4:
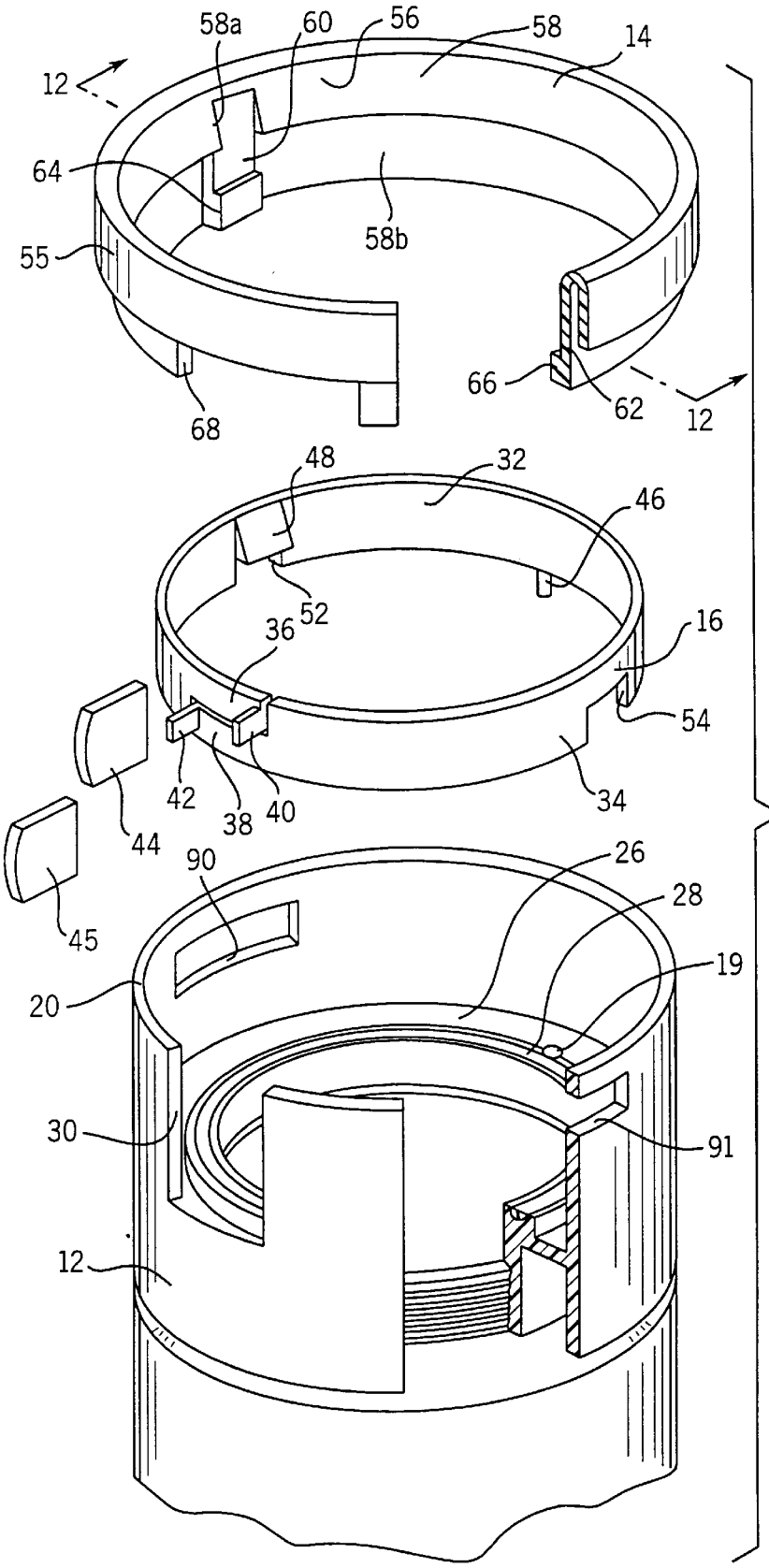
FIG. 4 is an enlarged exploded view of a portion of the locking mechanism of FIG. 1.

FIG. 1 shows the combined brush and storage system of the present invention (generally 10). Referring also to FIGS. 2, 3 and 4, the system 10 generally includes four separate components or assemblies including a container 12, a locking key ring 14, a locking collar 16 and a brush assembly 18. Unless otherwise specified, all of the components and assemblies of the system are preferably made of plastic such as ABS of polyethylene.

As best seen in FIG. 3, container 12 includes a floor wall 15 and a cylindrical peripheral cavity sidewall 13 which extends upwardly from wall 15 to an upper edge 20. Walls 13 and 15 together define a storage cavity 22. Below edge 20 a circumferential flange 24 extends radially inwardly forming a ledge 26. O-ring 28 is positioned on ledge 26 and is preferably made of rubber. Wall 13 has an opening 30 between ledge 28 and edge 20 (see FIGS. 1 and 4). Opposite opening 30 a post aperture 19 extends downward through ledge 26. Wall 13 also forms first and second apertures 90, 91 which pass through opposing sides of wall 13. Each aperture 90, 91 is preferably formed approximately 90 circumferential degrees from aperture 19 and each is approximately twice as long as opening 30.

Figure 5:
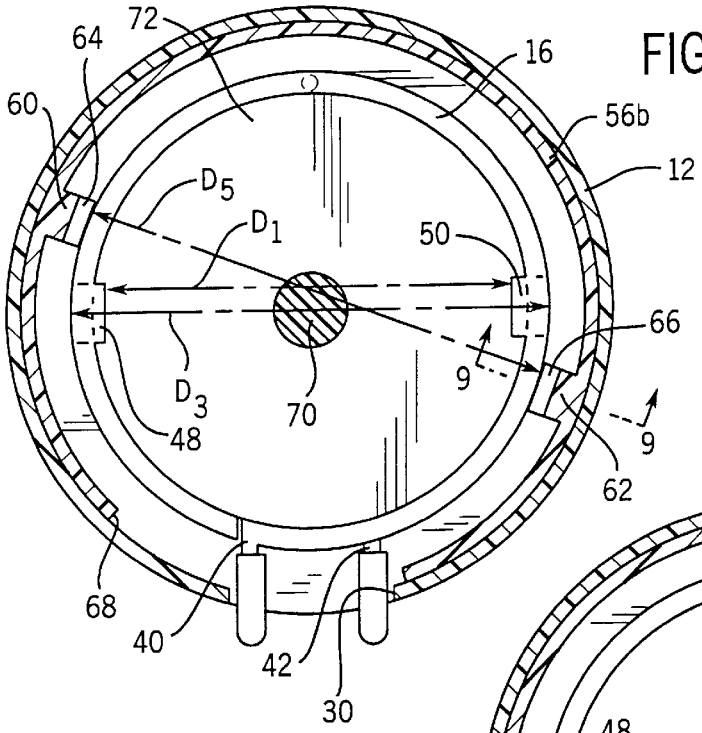
FIG. 5 is a cross-sectional view taken along 5—5 of FIG. 3 with a locking key in a locking configuration.

Referring to FIGS. 3, 4 and 5, collar 16 includes a radially resilient band having an inner surface 32, an outer surface 34, and first and second ends 36 and 38, respectively. Ends 36 and 38 extend past each other and are interleaved (see FIG. 4). First and second tabs 40, 42, respectively, extend radially outwardly as part of second ends 36, 38, respectively. Finger pads 44 and 45 may be provided on each of tabs 40 and 42. Opposite tabs 40 and 42 a single alignment post 46 extends downwardly from collar 16. Post 46 is formed so that it fits snugly within aperture 19. Collar 16 may be formed of resilient metal (or if desired a resilient plastic).

First and second latches 48, 50 extend radially inward from opposite sides of surface 32 and each is preferably positioned so as to be approximately 90 circumferential degrees from post 46. Just below latches 48 and 50, external surface 34 define two recesses 52, 54. In the figures recesses 52 and 54 are illustrated as openings.

Figure 7:
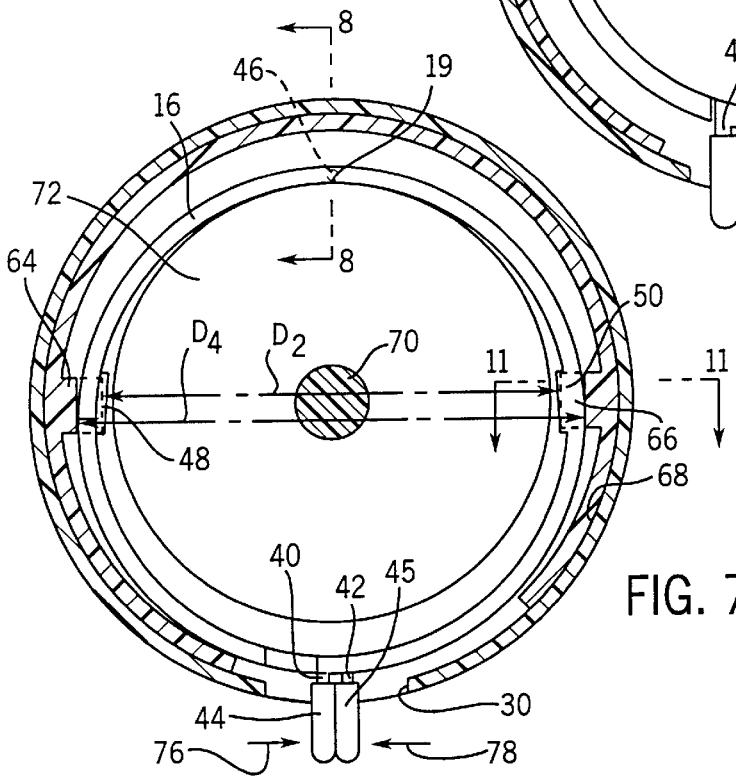
FIG. 7 is a view similar to FIG. 6 with a collar in an expanded position.

Referring to FIGS. 5 and 7, a diameter $D_n$, where n is 1 or 2, is defined by the distal edges of latches 48 and 50 and diameter $D_n$ can be manipulated by changing the spacial relationship between tabs 40 and 42 (i.e. ends 36 and 38). In addition, a diameter $D_m$, where m is 3 or 4, is defined by collar outer surface 34 taken through latches 48 and 50 and diameter $D_m$ is also manipulated via tabs 40 and 42. In a relaxed or first position (see FIG. 5), ends 40 and 42 are separated and diameter $D_n$ is $D_1$ while diameter $D_m$ is $D_3$. However, when tabs 40 and 42 are pinched together into second position (see FIG. 7), latches 48 and 50 are forced radially outwardly, diameter $D_n$ is $D_2$ where $D_2$ is greater than $D_1$ and diameter $D_m$ is $D_4$ where $D_4$ is greater than $D_3$.

Figure 12:
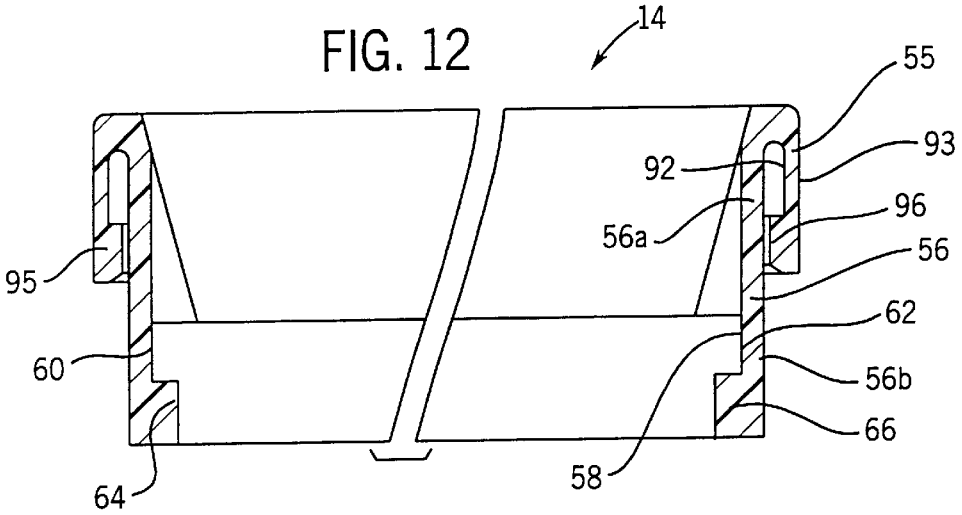
FIG. 12 is a cross-sectional view taken along line 12—12 of FIG. 4.

Referring still to FIGS. 3, 4 and 5 and also to FIG. 12, key 14 is in the form of a slip ring or skirt mounted over upper edge 20 having external and internal walls 55 and 56, respectively. Wall 55 defines internal and external surfaces 92, 93 (see FIG. 9). Wall 56 defines an internal surface 58 and includes a top portion 56*a* and a bottom portion 56*b*. Portion 56*a* slops radially inwardly and downwardly while portion 56*b* is essentially vertical.

Two legs 60, 62 extend downwardly from opposite sides of portion 56*a* and radially inwardly from portion 56*b*. A separate foot 64, 66 extends radially inwardly from the distal end of each of legs 60 and 62. Feet 64 and 66 are sized such that they are receivable in recesses 52 and 54 when the key is aligned to permit this. The distal edges of feet 64 and 66 define a diameter $D_5$ which is essentially equal to diameter $D_3$ (see FIG. 5). Approximately 90 circumferential degrees from leg 60, lower portion 56*b* forms an opening 68 which is approximately twice as long (in the circumferential direction) as opening 30.

First and second securing feet 95, 96 extend radially inward from the distal edge of internal surface 92. Foot 95 is circumferentially aligned with foot 64 while foot 96 is circumferentially aligned with foot 66. Feet 95 and 96 are sized so as to be snugly receivable within apertures 90 and 91 but to be approximately half as long (in the circumferential direction) as apertures 90 and 91.

Brush assembly 18 has an upper handle 70, a radially extending generally disk-like support wall 72 sized to rest on o-ring 28 and then on ledge 26, and a lower bristle or pad section 74. Alternatively, other brushing means can be used. A diameter $D_6$ (see FIG. 2) of wall 72 is greater than diameter $D_1$ but less than diameter $D_2$.

Disinfectant/cleaning fluid can be added to the cavity 13 to cover bristles 57. Numerous known fluids of this type can be used. One such fluid is 0.4% alkyl dimethyl benzyl ammonium chloride, 0.01% of a dye such as Acid Blue, and the remainder water. If desired, a portion of the water can be replaced with a surfactant compatible with the disinfectant to provide 1% non-ionic surfactant (e.g. an ethoxylated alcohol such as L-24-9 from Huntsman). Also, a perfume oil can also be added (e.g. 0.1%). Other disinfectants may also be used.

Figure 8:
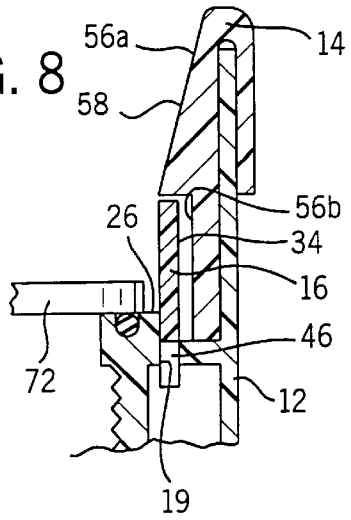
FIG. 8 is a cross-sectional view taken along line 8—8 of FIG. 7.

Referring to FIG. 3, when assembled, post 46 is received in aperture 19 (see FIG. 8) and collar 16 rests on ledge 26 with tabs 40 and 42 aligned with and extending radially out of opening 30. (See FIGS. 1, 2 and 5). Key 15 straddles edge 20 with lower portion 56*b* extending between wall 13 and collar 16 above ledge 26 and with opening 68 aligned with opening 30. Outer surface 34 faces internal surface 58 of portion 56*b* and feet 95 and 96 are received within apertures 90 and 91, respectively. Once feet 95 and 96 are secured in apertures 90 and 91, key 14 is axially locked onto edge 20 and maintains collar 16 thereunder. Nevertheless, key 14 can be rotated through an angle (e.g. 20E) about edge 20. During rotation feet 95 and 96 slide along the lengths of apertures 90 and 91.

First and second alignment markers 41 and 43 (see FIGS. 1 and 2) are provided on external and easily observable surfaces of container 12 and key 14. Markers 41 and 43 are aligned when feet 64 and 66 are adjacent recesses 52 and 54 and are misaligned when feet 64 and 66 are not aligned with recesses 52 and 54, respectively.

Figure 6:
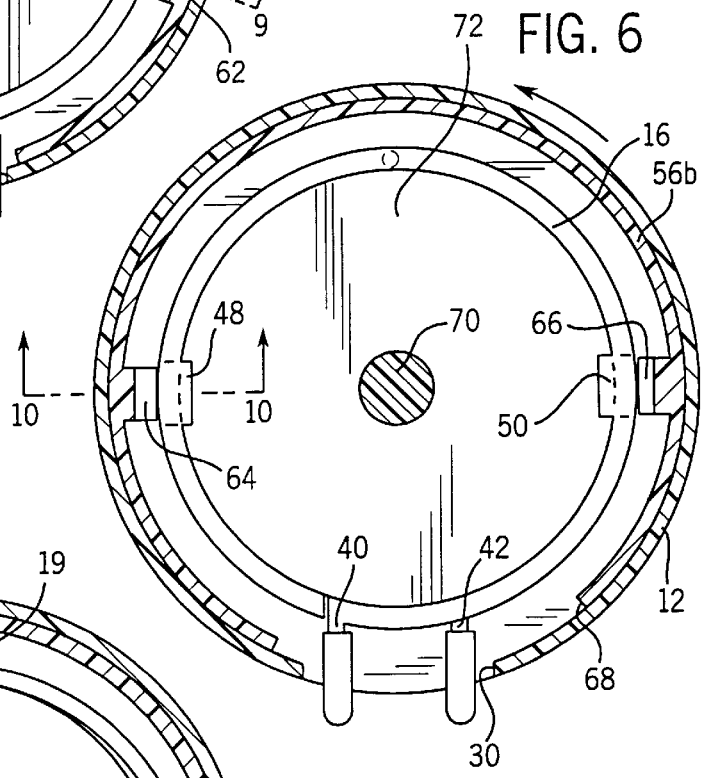
FIG. 6 is a view similar to FIG. 5, albeit with the locking key in an unlocking configuration.
Figure 10:
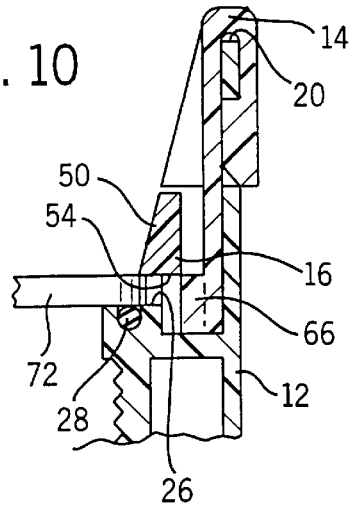
FIG. 10 is a cross-sectional view taken along line 10—10 of FIG. 6.
Figure 11:
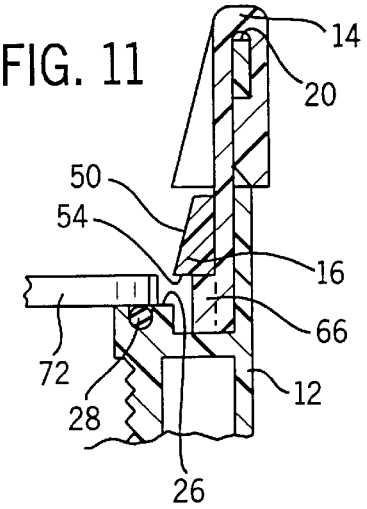
FIG. 11 is a cross-sectional view taken along line 11—11 of FIG. 7.

Referring to FIG. 6, in order to secure brush 74 inside container 12, key 14 is rotated about edge 20 until feet 64 and 66 are aligned with recesses 52 and 54 (i.e. markers 41 and 43 are aligned). (See FIGS. 2, 6 and 10). When key 14 is rotated, feet 95 and 96 slide along the circumferential lengths of recesses 90 and 91. With recesses 52, 54 and feet 64 and 66 aligned, one can push on opposite sides of tabs 40 and 42 as illustrated by arrows 76 and 78 in FIG. 7 forcing tabs 40 and 42 together. When tabs 40 and 42 are pinched together, latches 48 and 50 are forced radially outward and diameter $D_n$, is expanded to $D_2$ (see FIGS. 7 and 11). Because feet 64 and 66 are aligned with recesses 52 and 54, they are received therein and do not impede expansion of collar 16.

When latches 48 and 50 are forced radially outward, because wall 72 diameter $D_6$ is less than diameter $D_2$, section 74 can be inserted into container 12 such that wall 72 rests on o-ring 78. Next, tabs 40 and 42 are released, collar 16 resiliently contracts back to its original position with latches 48 and 50 above o-ring 28 defining diameter $D_1$. Latches 48 and 50 "step on" support wall 72 and secure the wall in place.

Figure 9:
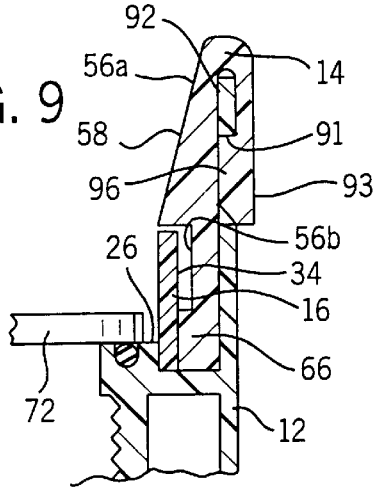
FIG. 9 is a cross-sectional view taken along line 9—9 of FIG. 5.

To ensure that latches 48 and 50 are not inadvertently removed from this "locking position", key 14 can be rotated about edge 20 until feet 64 and 66 are misaligned with recesses 52 and 54 (i.e. markings 41 and 43 are misaligned) (compare FIGS. 5 and 9 with FIG. 6). When key 14 is in this second configuration, feet 64 and 66 contact outer surface 34 and restrict expansion of collar 16 such that diameter $D_n$ is limited to $D_1$ and $D_m$ is limited to $D_3$. Thus, when markers 41 and 43 are misaligned, if pressure is applied to tabs 40 and 42, radially outward movement of latches 48 and 50 is impeded and latches 48 and 50 secure section 74 within container 12.

When assembly 18 is again to be used, one picks up system 10 via handle 70 and transports the entire system to an area for use. One rotates key 14 from the locking configuration (see FIGS. 1, 5 and 9) to the unlocked configuration (see FIGS. 2, 6 and 10) with markings 41 and 43 aligned. Next, one forces tabs 40 and 42 from the locking position (see FIGS. 1 and 6) to the unlocking position (see FIGS. 2 and 7) and removes assembly 18 from container 12 for use.

What has been described above are the preferred embodiments of the present invention. Other embodiments are also within the intended scope of the claims. For example, while the system is described as one wherein the outer surface of collar 16 forms a recess and the internal surface of key 14 forms legs and feet, these elements could be reversed. For example, the legs and feet or, for that matter, just feet, could be formed on the outer surface of collar 16 and the recesses could be formed in the internal surface of key 14.

In addition, the invention is meant to include a system wherein the key does not rotate to lock the collar in a single configuration. Moreover, the system may include more than two latches or the latches may be located at different circumferential positions with respect to each other or with respect to tabs 40 and 42. As such, the claims which follow should be looked to in order to judge the full scope of the invention.

Industrial Applicability

We claim:

1. A combined brush and storage container system, comprising:

a container having an upper edge, an internal storage cavity extending downward from the edge to define a peripheral cavity sidewall and a ledge formed on the sidewall;

a radially resilient collar disposed over the ledge, the collar having first and second ends, and a latch extending radially inward;

a key mounted on the upper edge adjacent the collar for maintaining the collar within the cavity;

a brush having an upper handle, a radially extending support below the upper handle and a lower brush portion below the support;

wherein, when the brush portion is inserted in the container the support is supported over the ledge, and wherein relative movement of the first and second ends from a first position to a second position can drive the latch radially outward from a position blocking removal of the brush, and wherein return of the ends to the first position from the second position can cause the latch to move radially inward.

2. The system of claim 1, wherein the collar and cavity are cylindrical.

3. The system of claim 1, wherein:

the collar includes oppositely facing inner and outer surfaces and the latch extends radially inward from the inner surface;

the key is mounted for rotational movement around the edge and includes a lower portion extending downward into the cavity between the collar and the sidewall, the lower portion having an internal surface;

the collar external surface and the lower portion internal surface each are a limiting surface, a first of the limiting surfaces having a recess and a second of the limiting surfaces having a foot extension extending toward the first limiting surface, the recess and foot each being limiters; and when the key is in a first placement the foot is misaligned with the recess and contacts the first limiting surface, and when the key is rotated from the first to a second placement the foot is aligned with the recess and the first and second ends of the collar can be moved relative to one another.

4. The system of claim 3, wherein the collar external surface forms a first of the limiters circumferentially adjacent the latch.

5. The system of claim 4, wherein the latch and the recess are circumferentially aligned.

6. The system of claim 5, wherein the collar external surface is the first limiting surface and the key internal surface is the second limiting surface.

7. The system of claim 6, wherein there are two latches extending inward from opposite sides of the collar, two recesses formed on opposite sides of the collar and two feet extending from opposite sides of the lower portion.

8. The system of claim 3, wherein an alignment post extends axially downwardly from the collar opposite the first and second ends and the ledge forms an aperture for receiving the post.

9. The system of claim 1, wherein the container has an opening in the sidewall adjacent the first and second ends, and the collar includes first and second radially outward extensions as part of said ends.

10. The system of claim 9, wherein the first and second ends overlap.

11. The system of claim 3, wherein the key and the container include first and second exterior markings, respectively, the markings being alignable when the latch does not prevent removal of the brush from the container.

12. The system of claim 1, wherein the brush support is a wall.

13. The system of claim 1, further comprising an o-ring positioned on the ledge.

14. The system of claim 1, wherein the system also comprises disinfectant fluid in the container cavity.

15. A method of storing a brush, comprising positioning the claim 1 toilet cleaning brush in the claim 1 container.

* * * * *